US009109334B1

(12) United States Patent
Bourget

(10) Patent No.: US 9,109,334 B1
(45) Date of Patent: Aug. 18, 2015

(54) BACKER ROD INSTALLATION TOOL

(71) Applicant: Kyle Bourget, Augusta, KS (US)

(72) Inventor: Kyle Bourget, Augusta, KS (US)

( * ) Notice: Subject to any disclaimer, the term of this patent is extended or adjusted under 35 U.S.C. 154(b) by 0 days.

(21) Appl. No.: 14/301,181

(22) Filed: Jun. 10, 2014

(51) Int. Cl.
*E01C 23/09* (2006.01)
*E04F 21/165* (2006.01)

(52) U.S. Cl.
CPC ..... *E01C 23/0986* (2013.01); *E04F 21/165* (2013.01)

(58) Field of Classification Search
CPC ..... E01C 23/026; E01C 23/04; E01C 23/00; E01C 23/0986; E04F 21/00; B25B 27/0092; E04D 15/04
USPC ..... 404/87
See application file for complete search history.

(56) References Cited

U.S. PATENT DOCUMENTS 2,761,199 A 9/1956 Allen
3,050,273 A * 8/1962 Saunders ..... 242/557
3,364,828 A 1/1968 Shope et al.
3,366,022 A * 1/1968 Mock ..... 404/74
3,395,627 A 8/1968 Barton
3,413,901 A * 12/1968 Lusk ..... 404/87
3,422,734 A * 1/1969 Tonjes et al. ..... 404/87
3,466,988 A * 9/1969 Sharpe ..... 404/107
3,538,820 A * 11/1970 Tonjes ..... 404/74
3,608,445 A * 9/1971 Sharpe ..... 404/87
4,077,731 A * 3/1978 Holz et al. ..... 404/83
4,136,993 A * 1/1979 Fletcher ..... 404/88
4,548,016 A * 10/1985 Dubich et al. ..... 52/749.12
4,699,540 A 10/1987 Gibbon et al.
4,738,562 A * 4/1988 Howsley ..... 404/87
4,765,771 A * 8/1988 Howsley ..... 404/74
4,916,790 A * 4/1990 Vlahogeorge ..... 29/235

* cited by examiner

*Primary Examiner* — Abigail A Risic
(74) *Attorney, Agent, or Firm* — Kenneth H. Jack; Davis & Jack, L.L.C.

(57) ABSTRACT

A tool for installing a length of backer rod, the backer rod being sized for insertion into a contraction joint within a concrete slab, the tool including a first carriage; a plurality of wheels mounted upon the carriage, the wheels being arranged for facilitating rolling motion of the first carriage along the contraction joint; a second carriage sized for suspension beneath the first carriage; a plurality of backer rod depressing disks including a frontmost disk, each disk being mounted rotatably upon the second carriage; jack screw disk positioners interconnecting the carriages and being adapted for, upon the rolling motion along the contraction joint, downwardly extending the disks into the contraction joint; a backer rod guide tube connected to the first carriage and being adapted for continuously positioning the length of backer rod beneath the disks; and a handle connected operatively to the first carriage.

9 Claims, 5 Drawing Sheets

BACKER ROD INSTALLATION TOOL

CLAIM OF PRIORITY FROM PREVIOUSLY FILED PROVISIONAL PATENT APPLICATION

This non-provisional patent application claims the benefit of and priority from U.S. provisional patent application No. 61/845,680 filed Jul. 12, 2013. The inventor disclosed in and applicant of said provisional application is the same person as the person who is disclosed as the inventor in and applicant of the instant application. The applicant asserts that structures and functions of structures disclosed and described in the instant application are substantially identical to those disclosed in said provisional application.

FIELD OF THE INVENTION

This invention relates to tools and assemblies which are adapted for assisting in cutting and placement of contraction joints within concrete slabs. More particularly, this invention relates to such tools and assemblies which are adapted for assisting in insertions of lengths of elastomeric foam backer rod within such joints.

BACKGROUND OF THE INVENTION

Concrete slabs such as concrete building foundations, concrete floors, patios, parking lots, and the like often experience concrete shrinkage subsequent to initial pouring and hardening of the concrete slab. Such shrinkage often results in irregular, unsightly, and hazardous cracking throughout the concrete slab. In order to lessen or ameliorate the negative effects of such concrete shrinkage and irregular cracking, a regular matrix of narrow contraction joints are commonly placed by saw cutting into the surface of the concrete slab.

Such saw cut contraction joints are often desirably filled with an elastomeric caulk or filler material. For example, where a saw cut concrete slab must support heavy equipment including hard rollers, a semi-rigid filler may be placed within the saw cut to prevent breakage and chipping at the edges of the saw cut. Such saw cuts may also be filled to prevent unsanitary dirt and debris from accumulating within the saw cut, and in such circumstances a flexible rubberized caulk may be placed within the saw cuts.

In many circumstances, the vertical depth of a concrete slab contraction joint exceeds a desired vertical dimension or fill depth of contraction joint filler. For example, a 2 inch deep contraction joint may be desirably filled only to a depth of ½ inch. In such circumstances, means for preventing the initially viscous filler from downwardly seeping into the joint below the ½ inch level during curing and hardening are desirably provided. Such means commonly take the form of flexible lengths of elastomeric foam backer rod or seam packing strands whose diameters are closely fitted to the lateral dimension of a contraction joint. Such backer rod may be inserted downwardly into a contraction joint and friction between the backer rod and the joint's walls effectively holds the backer rod at a desired depth. Such elastomeric foam backer rod insertions create a needed floor for temporary support for contraction joint fill during fill hardening.

Manual processes for inserting such elastomeric foam backer rod into saw cut contraction joints within a slab are time consuming, laborious, and result in undesirable waste of man hours. The instant inventive backer rod installation tool solves or ameliorates such problems and deficiencies by providing a specially configured wheeled tool which allows a single worker to progressively install backer rod within a concrete expansion joint in a timely and economic fashion.

BRIEF SUMMARY OF THE INVENTION

A first structural component of the instant inventive backer rod installation tool comprises a first wheeled carriage. In a preferred embodiment, the first wheeled carriage comprises a heavy chassis configured as or adapted from short length of downwardly opening steel "C" channel stock. Preferably, the lateral flanges of the "C" channel stock member have a 2½ inch to 4 inch vertical dimension, and the web portion of such "C" channel stock member has a lateral dimension between 5 inches and 8 inches. The longitudinal or front to rear dimension of the "C" channel stock member preferably is between 10 inches and 14 inches. Other carriage chassis configurations capable of wheel support for rollable movement across flat surfaces are considered to fall within the scope of the invention.

A further structural component of the instant inventive backer rod installation tool comprises a second wheeled carriage which is preferably adapted for rotatably supporting a series of backer rod depressing wheels or disks. Each wheel among the series of backer rod depressing wheels preferably has a lateral thickness which is less than the narrowest contraction joint into which foam backer rod is to be installed. For example, where the narrowest such joint has a lateral dimension of ¼ inch, the lateral thickness of each of the backer rod depressing wheels is preferably between 3/32 and 5/32 inches. In order to assure proper backer rod contact, the lateral thickness of each backer rod depressing wheel preferably spans at least one-fourth of the lateral width of a subject contraction joint.

Each backer rod depressing wheel also preferably has a radius which is greater than the greatest depth at which backer rod is to be installed within a contraction joint. For example, where such greatest depth equals 1 inch, the radius of the backer rod depressing wheels preferably is at least 1½ inch, the ½ inch excess dimension accommodating an axle diameter and some amount of upward elastic rebound of an installed lengths of backer rod.

In a preferred embodiment of the instant inventive tool, the series of backer rod depressing wheels are rotatably supported by a second carriage which is adapted for holding the backer rod depressing wheels in longitudinal alignment with respect to each other, and is adapted for further holding such wheels within a single common substantially vertical plane. Similarly with the first wheeled carriage's preferred configuration as a length of downwardly open length of "C" channel stock, the second wheeled carriage preferably comprises a second length of downwardly opening "C" channel stock. Such second "C" channel is preferably sized and fitted for suspended support within the "C" concavity of the first wheeled carriage. Other carriage constructions and frameworks capable of rotatably supporting the series of backer rod depressing wheels are considered to fall within the scope of the invention.

A further structural component of the instant inventive backer rod installation tool comprises wheel positioning means which operatively interconnect the first and second wheel carriages. In a preferred embodiment, the wheel positioning means are adapted for variably vertically positioning the second wheeled carriage with respect to the first wheeled carriage and for variably angularly orienting the second wheeled carriage and attached backer rod depressing wheels within the vertical plane. In a preferred embodiment, the wheel positioning means comprise at least a first, and preferably first and second jack screw actuators which are adapted for variably raising and lowering the front and rear or longitudinal and oppositely longitudinal ends of the second wheeled carriage. Other positioning means such as variably positionable slide bar supports and rotatingly positionable cams are considered to fall within the scope of the invention.

A further structural component of the instant inventive backer rod installation tool comprises backer rod guiding means which are preferably fixedly attached to a longitudinal or front end of the first wheeled carriage. In a preferred embodiment, the backer rod guiding means are adapted for receiving a length of elastomeric foam backer rod and progressively dispensing the foam backer rod at a location preferably adjacent a forward and downward aspect of a forward-most backer rod depressing wheel among the series of backer rod depressing wheels. In a preferred embodiment, the backer rod guiding means comprise a curved slide tube or sleeve which is fitted for slidably receiving the backer rod. The backer rod guiding means may suitably alternatively comprise a backer rod guiding frame, guide loop series, or a series of frame supported pulley guides.

A further structural component of the instant inventive backer rod installation tool comprises spool means which preferably include a flanged spool, a rotation axle, and a spool support frame. In a preferred embodiment, the spool support frame adjustably supports the spool and its axle at varying selected angles over the first wheeled carriage so that backer rod coiled about the spool may continuously dispense directly toward the backer rod guide means.

Handle means are preferably provided so that an operator walking behind the tool may forwardly roll the first wheeled carriage along a saw cut contraction joint within a concrete slab. The invention's depression wheel positioning means are preferably previously manipulated to vertically position the series of rod depressing wheels within the saw cut, such positioning allowing such wheels to effectively guide the tool's rolling motion along the saw cut. Upon an initial direct dispensation of the elastomeric foam backer rod beneath the depression wheels, as described above, such wheels continuously depress the backer rod into and along the saw cut to a desired depth. Operation of the tool in the manner described above advantageously allows a single backer rod installer to progressively and continuously install long lengths of backer rod within a saw cut contraction joint, such process saving time and worker man hours.

Accordingly, objects of the instant invention include the provision of a backer rod installation tool which incorporates structures as described above, and which arranges those structures in relation to each other in manners described above for achievement of the advantages and benefits described above.

Other and further objects, benefits, and advantages of the present invention will become known to those skilled in the art upon review of the Detailed Description which follows, and upon review of the appended drawings.

STATEMENT REGARDING CHARACTER OF DRAWINGS

Drawing FIGS. 1-5 described below are partially photographic in character, and the Applicant does not petition for the allowance of photographic drawings. Notwithstanding, the Applicant asserts that the drawings are such that the examination can be carried out without the submission of corrected drawings showing the depicted structures in black lines only, and that the drawings are expected to be legible after scanning, making them drawings acceptable under the provisions of MPEP 507(F). Accordingly, the Applicant requests under MPEP §608.02(b) that the drawings be admitted for examination purposes, and that any requirement for submission of black line drawings be imposed only following examination of the application.

DETAILED DESCRIPTION OF A PREFERRED EMBODIMENT

Figure 1:
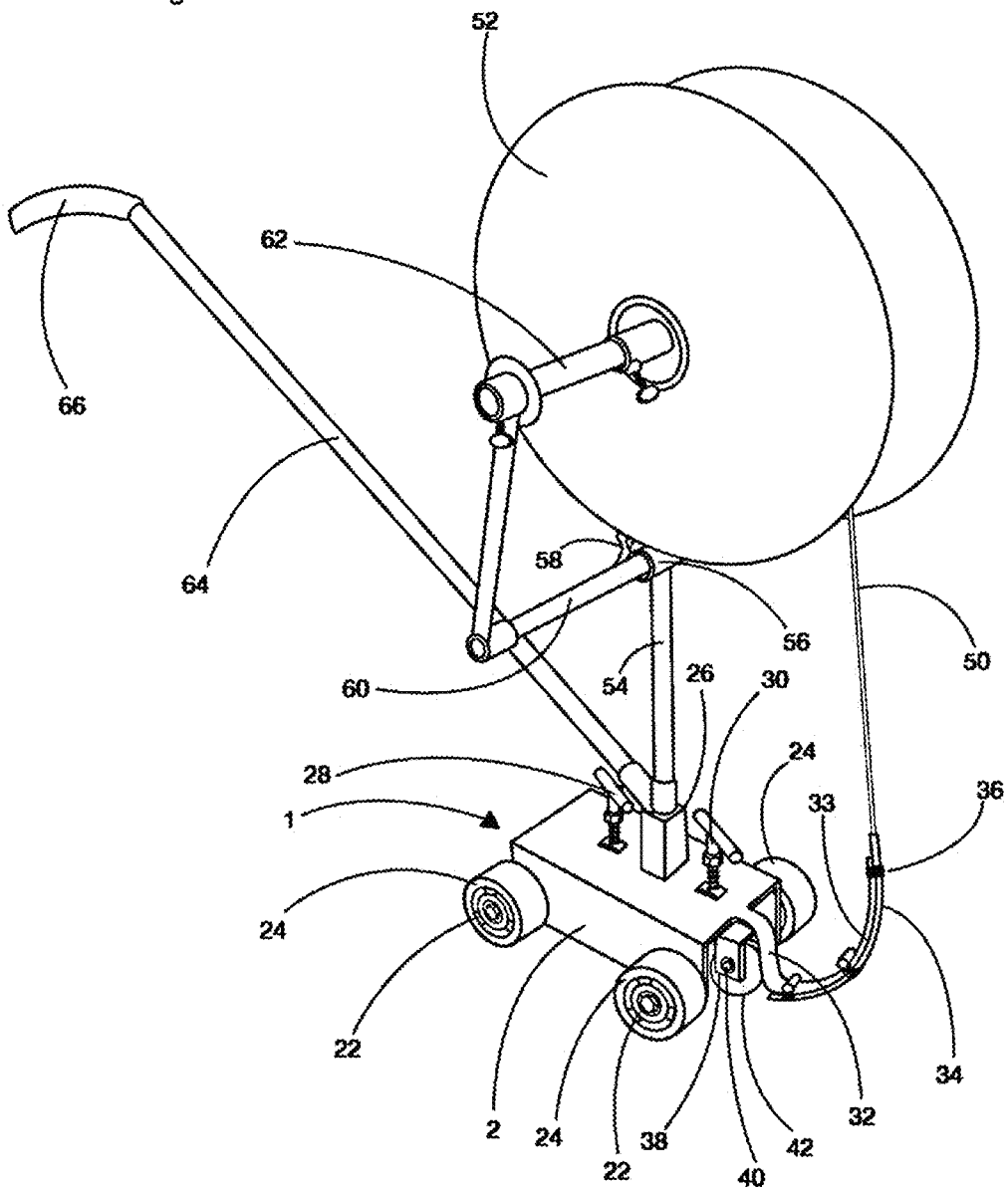
FIG. 1 is a perspective view of a preferred embodiment of the instant inventive backer rod installation tool.
Figure 4:
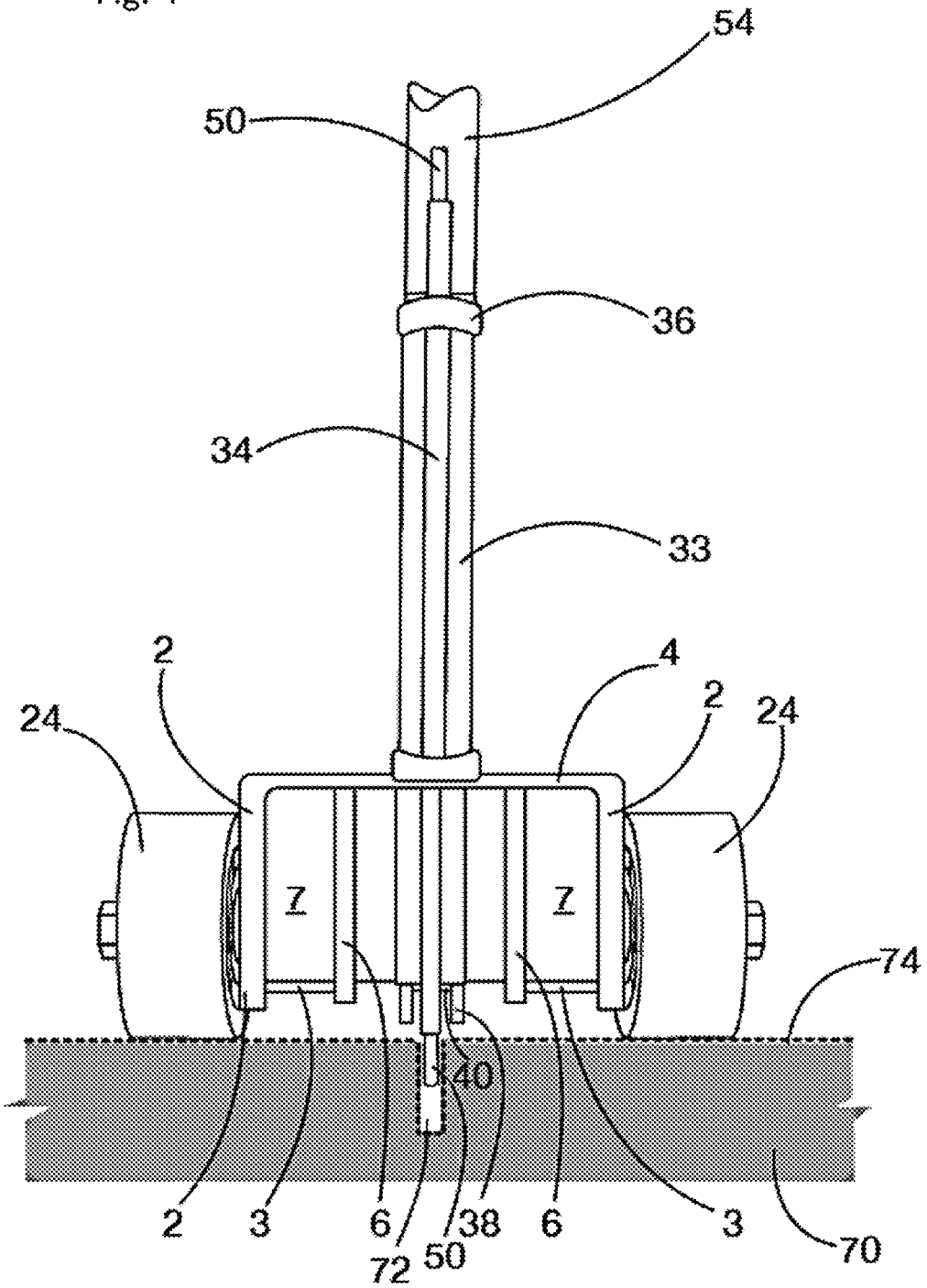
FIG. 4 is a partial front view of the backer rod tool depicted in FIG. 1.

Referring now to the drawings, and in particular to Drawing FIG. 1, a preferred embodiment of the instant inventive backer rod installation tool is referred to generally by Reference Arrow 1. Referring further simultaneously to FIG. 4, the tool 1 preferably comprises a first wheeled carriage component which is preferably configured as a length of steel "C" channel beam having left and right flanges or side walls 2, and having an upper web portion 4 which spans laterally between and rigidly interconnects upper ends of flanges 2. Such "C" channel beam configuration of the first wheeled carriage component 2,4 advantageously forms and defines an interior housing space 7 within which other functional structures of the tool may be conveniently housed and operatively deployed.

Referring to FIG. 1, journal or stub axles 22 are preferably fixedly attached to and extend laterally and oppositely laterally from the side walls 2 of the first wheeled carriage 2,4, such journal axles 22 rotatably mounting and supporting wheels 24.

Referring simultaneously to FIGS. 2-5, interior suspension ties 6 are preferably fixedly attached to and extend downwardly from web 4. Ballast support cross bars 3 preferably extend laterally between the lower ends of flanges 2 and the lower ends of suspension ties 6. Ballast bars 80 may be inserted and stacked within spaces 7, and may be supported by cross bars 3. Such ballast bars 80 enhance the tool's lateral stability and increase the down force applied by the tool to backer rod, as further described below.

Figure 2:
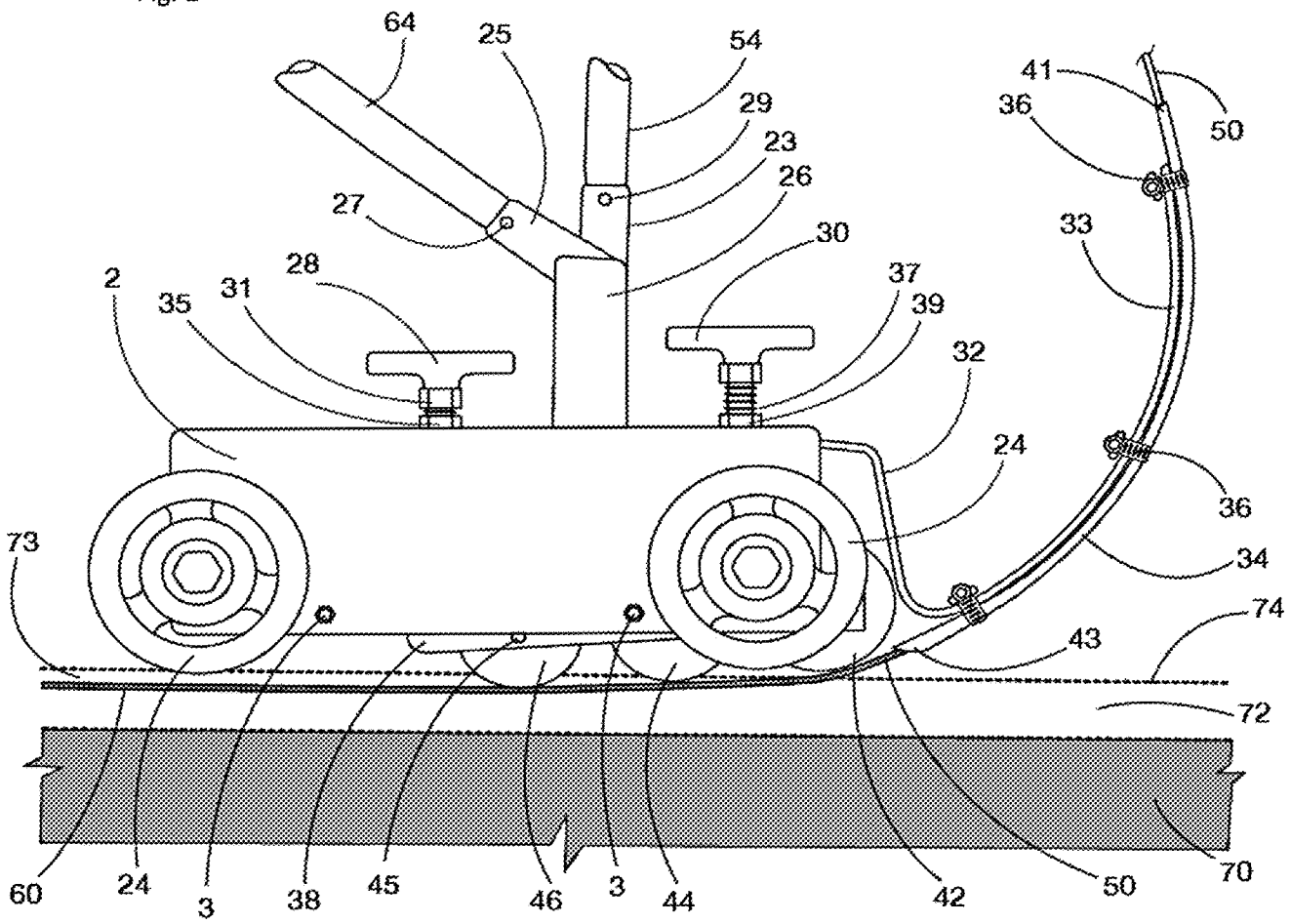
FIG. 2 is a partial side view of the structure depicted in FIG. 1, the view of FIG. 2 further showing in cross-sectional view a concrete slab having a contraction joint saw cut shown in dashed lines.
Figure 5:
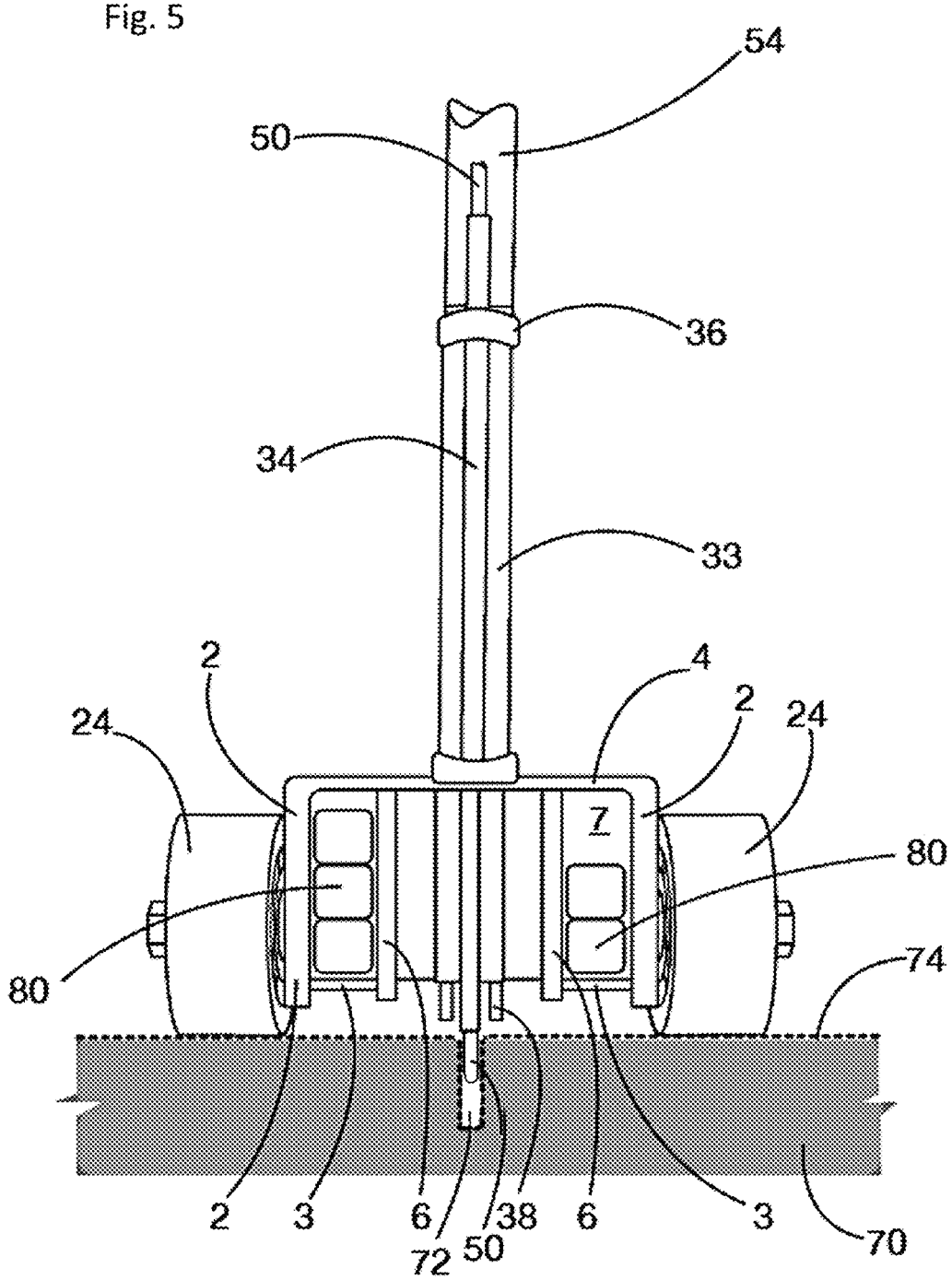
FIG. 5 redepicts the structure of FIG. 4, the view of FIG. 5 further showing a plurality of ballast bars supported within the first wheeled carriage component.

Referring simultaneously to FIGS. 2 and 5, a mounting post 26 is preferably fixedly attached to and extends upwardly from the upper surface of web 4, such post 26 preferably having at its upper end an upwardly opening spool bracket mounting socket 23, and having an upwardly and rearwardly opening handle mounting socket 25. Set screws 27 and 29 are preferably incorporated within mounting sockets 25 and 23 for alternatively attaching and releasing handle and spool bracket components which are further described below. Such set screw and socket combinations 23, 25, 27, 29 allow for quick assembly and disassembly and for compact storage of the tool.

Figure 3:
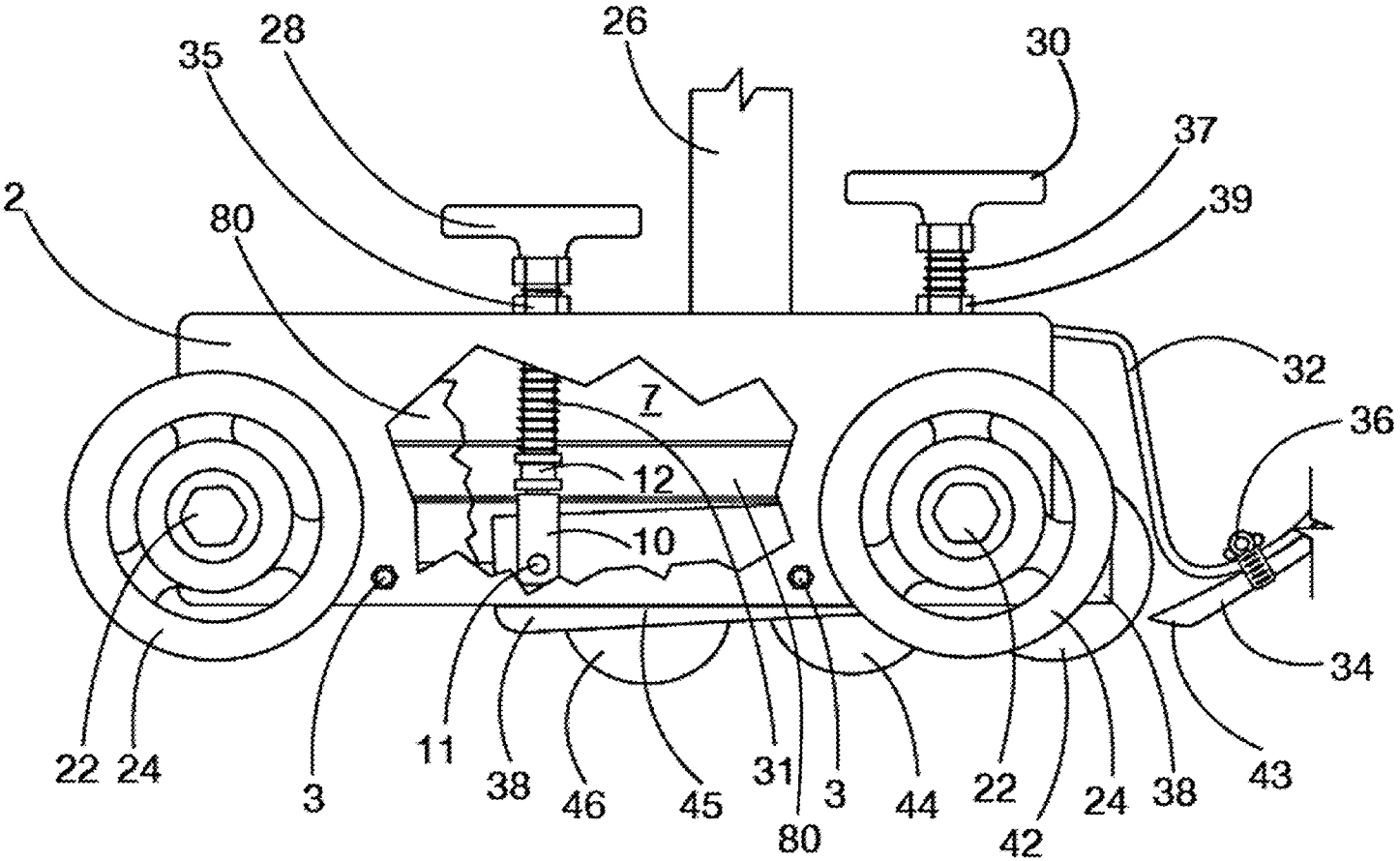
FIG. 3 presents an alternative side view of the tool of FIG. 1, the view of FIG. 3 including a cutaway section showing interior structure.

Referring simultaneously to FIGS. 1, 2, and 3, the instant inventive tool 1 preferably further comprises a second wheeled carriage which is preferably configured as a second smaller length of "C" channel beam 38. A longitudinal series of backer rod depressing wheels 42, 44, and 46 are preferably rotatably mounted upon axles 40 and 45 (the axle supporting wheel 44 not being shown within views) which span the flanges of beam 38. Such second carriage is preferably mounted within the downwardly opening space 7 and between the flanges 2 of the "C" channel beam carriage 2,4.

In the preferred embodiment, the second wheeled carriage 38 preferably vertically orients and longitudinally aligns the wheels 42, 44, and 46 with respect to each other, each of such wheels preferably having dimensions and being sized substantially identically with each other such wheel. While the second wheeled carriage 38 may suitably support a lesser or greater number of backer rod depressing wheels, the depicted triple of backer rod depressing wheels 42, 44, and 46 is preferred.

Referring simultaneously to FIGS. 1, 3 and 4, the instant inventive tool 1 preferably further comprises second carriage positioning means which operatively connect the second carriage 38 and its series of backer rod depressing wheels 42, 44, and 46 to the first carriage 2,4. In the preferred embodiment, the second carriage positioning means are adapted for alternatively and selectively raising and lowering the longitudinal and oppositely longitudinal or front and rear ends of the second carriage 38. Such positioning means preferably comprise front and rear jack screw actuator assemblies as shown in FIG. 3, the rear jack screw assembly including a combination of a helically threaded shaft 31, a helically threaded nut 35 fixedly attached at an eye in the web 4, a "T" handle 28 mounted to the upper end of shaft 31, a clevis and pin joint 10 and 11 mounted to the second carriage 38, and a swivel joint 12 interconnecting clevis 10 and the lower end of threaded shaft 31.

In operation, alternative clockwise and counter-clockwise of turning "T" handle 28 raises and lowers the rearward end of carriage 38 with respect to carriage 2,4. A forward jack screw assembly component of the second carriage positioning means including threaded shaft 37, threaded nut 39, and "T" handle 30 (other components not being depicted within views) is preferably configured substantially identically with the rearward jack screw assembly. Similarly, with operation of the rear jack screw, the front jack screw may operate for alternatively raising and lowering the forward end of the second carriage 38.

The jack screw assembly positioning means depicted in FIG. 3 is intended as being representative of other suitable linear motion actuators such as variably positionable slide shafts and cams which may be suitably alternatively used for raising and lowering forward and rearward ends of the second carriage 38 with respect to the first carriage 2,4.

Referring simultaneously to FIGS. 1, 2, and 4, the instant inventive tool preferably further comprises backer rod guide means which are adapted for receiving elastomeric foam backer rod 50, and for progressively guiding such backer rod 50 in engagement with the series of backer rod depressing wheels 42, 44, and 46. In the preferred embodiment, the backer rod guide means comprise a forwardly and upwardly extending bracket 32,33 which is fixedly attached to and extends forwardly from a forward edge of the first carriage's web 4. The curved portion 33 of the bracket 32,33 preferably supports a curved slide tube 34 which has an upper opening 41 for receiving the backer rod 50 and which has a lower opening 43 for downwardly and rearwardly dispensing the backer rod 50. A series of annular clamps 36 are provided for fixedly interconnecting tube 34 to bracket 33. The backer rod guide means 32,33,34 are intended as being representative of other suitably substituted brackets and guides such as loop supporting frames and pulley arrays which may alternatively guide the backer rod 50 into engagement with the depressing wheels 42, 44, and 46.

Referring to FIG. 1, the instant inventive backer rod installation tool 1 preferably further comprises spool means which are adapted for continuously supplying a length of backer rod 50 for guidance and dispensation by the backer rod guide means. In a preferred embodiment, the spool means comprise a combination of an annularly flanged spool 52 upon which backer rod 50 is wound, a transverse axle 62, an axle support frame 60, and a support column 54. In a preferred embodiment, support frame 60 extends through sleeve joint 56, and a manually actuated set screw 58 is provided for locking the frame 60 at a desired angular position and for releasing the frame 60 for repositioning the frame 60 and spool 52. By manipulating set screw 58 and by angularly frontwardly and rearwardly positioning the frame 60, the angular path of backer rod 50 from the spool 52 to the guide means tube 34 may be adjusted for assuring a straight and relatively friction free entry of the backer rod 50 into the tube 34. Other commonly known structural supports for upwardly associating a backer rod spool with the first carriage 2,4 are considered to fall within the scope of the invention.

Referring simultaneously to FIGS. 1 and 2, the instant inventive tool preferably further comprises handle means 64,66, the lower and forward end of handle shaft 64 being received within socket 25 and releasably secured by set screw 27.

Referring simultaneously to all figures, an operator may initially install a spool 52 of elastomeric foam backer rod 50 upon the axle rod 62 of frame 60. An end of the backer rod 50 may then be threaded into the upper opening 41 of guide tube 34, and such end may be threadedly guided therethrough until such end emerges from the lower end 43 of the guide tube 34. Upon such threaded installation of the backer rod 50, the operator may manipulate set screw knob 58 and may angularly position the spool frame 60 so that the extension of backer rod 50 from spool 52 substantially aligns with the upper opening 41 of the guide tube 34.

Thereafter, the operator may place the tool 1 upon the upper surface 74 of a concrete slab 70 having a saw cut contraction joint 72. The operator may then align the first carriage 2,4 so that wheels 24 evenly straddle the saw cut 72 and so that the backer rod depressing wheels 42, 44, and 46 vertically and longitudinally align with the saw cut 72. "T" handles 28 and 30 are preferably manipulated so that a rearward pair of such wheels 44 and 46 downwardly extend into the saw cut 72. Such manipulation of the jack screw "T" handles 28 and 30 may advantageously angularly arrange the second carriage 38 and its series of backer rod depressing wheels 42, 44, and 46 so that the forwardmost wheel 42 is at an upwardly adjusted position with respect to the rearwardmost wheel 46, such positioning allowing wheels 42, 44, and 46 to progressively downwardly insert the backer rod 50 into joint 72.

Thereafter, the operator may rearwardly extend the end of backer rod 50 until it underlies wheels 42, 44, and 46, and resides at a desired elevation within saw cut joint 72. Thereafter, the operator may walk behind the tool, driving it forward through application of a pushing force to handle 64,66. Such pushing force rolls the tool 1 along the saw cut 72 and during such motion the backer rod depressing wheels 44 and 46 continually guide the carriage 2,4 therealong. Simultaneously with such tool guidance, backer rod depressing wheels 42, 44, and 46 progressively downwardly insert the backer rod 50 into the saw cut 72, advantageously causing the backer rod 50 to serve as an intermediate level filler supporting floor within the saw cut joint 72. Following such progressive downward installation of the backer rod 50 within saw cut joint 72, an effective shallow channel 73 is formed, such channel 73 being suitable for receipt of and temporary support of a filler such as elastomeric caulking or a semi-rigid gap filler.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

The invention hereby claimed is:

1. A tool for installation of a length of backer rod, the backer rod being sized for insertion into a contraction joint within a concrete slab, the tool comprising:

(a) a first carriage comprising a downwardly opening "C" channel, the first carriage having a front end;

(b) a plurality of wheels rotatably mounted upon the first carriage, the plurality of wheels being arranged for facilitating a forward rolling motion of the first carriage upon the concrete slab and along the contraction joint;

(c) a second carriage comprising a second downwardly opening "C" channel, the second carriage being sized for suspension beneath the first carriage;

(d) a plurality of backer rod depressing disks comprising a frontmost disk, each disk among the plurality of backer rod depressing disks being mounted rotatably upon the second carriage and within the second downwardly opening "C" channel;

(e) Positioning means interconnecting the first and second carriages, the positioning means being adapted for, upon the forward rolling motion of the first carriage along the contraction joint, downwardly extending at least a first disk among the plurality of backer rod depressing disks into the contraction joint;

(f) backer rod guide means connected operatively to the first carriage, the backer rod guide means being adapted for continuously positioning the length of backer rod beneath the frontmost disk;

(g) backer rod supply means connected operatively to the first carriage, the backer rod supply means being adapted for dispensing the backer rod to the backer rod guide means; and (h) handle means connected operatively to the first carriage; wherein the positioning means comprise a first jack screw operatively interconnecting the first and second carriages.

2. The backer rod installation tool of claim 1 wherein the positioning means further comprise a second jack screw further operatively interconnecting the first and second carriages, wherein the first and second jack screws are adapted for variably angularly orienting the plurality of backer rod depressing disks within a substantially vertical and substantially longitudinally oriented plane.

3. The backer rod installation tool of claim 2 wherein the backer rod guide means are connected operatively to the front end of the first carriage, and wherein the backer rod guide means comprise a forwardly and upwardly extending bracket.

4. The backer rod installation tool of claim 3 wherein the backer rod guide means' forwardly and upwardly extending bracket comprises a tube having a bore fitted for slidably receiving the backer rod.

5. The backer rod installation tool of claim 4 wherein the backer rod supply means are connected operatively to the first carriage.

6. The backer rod installation tool of claim 5 wherein the backer rod supply means comprise a spool, axle, and support frame combination.

7. The backer rod installation tool of claim 6 wherein the handle means comprise an upwardly and rearwardly extending shaft.

8. The backer rod installation tool of claim 7 further comprising a plurality of ballast bars and ballast bar mounting means, the ballast bar mounting means operatively positioning the ballast bar's upon the first carriage.

9. The backer rod installation tool of claim 8 wherein the ballast bar mounting means comprise a plurality of ballast bar supporting brackets, said brackets being adapted for suspending the ballast bars within the first carriage's "C" channel.

* * * * *